US009251993B2

(12) United States Patent
Anno et al.

(10) Patent No.: US 9,251,993 B2
(45) Date of Patent: Feb. 2, 2016

(54) X-RAY TUBE AND ANODE TARGET

(71) Applicants: KABUSHIKI KAISHA TOSHIBA, Minato-ku (JP); Toshiba Electron Tubes & Devices Co., Ltd., Otawara-shi (JP)

(72) Inventors: Hidero Anno, Otawara (JP); Tetsuya Yonezawa, Yaita (JP)

(73) Assignees: KABUSHIKI KAISHA TOSHIBA, Minato-ku (JP); Toshiba Electron Tubes & Devices Co., Ltd., Otawara-shi (JP)

( * ) Notice: Subject to any disclaimer, the term of this patent is extended or adjusted under 35 U.S.C. 154(b) by 92 days.

(21) Appl. No.: 14/262,003

(22) Filed: Apr. 25, 2014

(65) Prior Publication Data

US 2014/0321620 A1 Oct. 30, 2014

(30) Foreign Application Priority Data

Apr. 30, 2013 (JP) ..... 2013-095324

(51) Int. Cl.
*H01J 35/10* (2006.01)

(52) U.S. Cl.
CPC ..... *H01J 35/105* (2013.01); *H01J 2235/1241* (2013.01)

(58) Field of Classification Search
CPC ..... H01J 2235/1241; H01J 35/105; H01J 35/108; H01J 2235/084; H01J 2235/081; H01J 2235/1204; H01J 2235/1229; H01J 9/18; C04B 2237/122; C04B 2237/125; C04B 2237/36; C04B 2237/363; C04B 2237/403; C04B 2237/404; C04B 2237/708; C04B 2237/76; H01L 21/02274; H01L 21/02126; H01L 21/02203; H01L 21/02348; H01L 21/31695; H01L 21/02216; H01L 21/67115; H01L 21/02208; H01L 21/288; H01L 21/3105; H01L 21/02167; H01L 21/02211; H01L 21/02214; H01L 21/02271
USPC ..... 378/142, 143
See application file for complete search history.

(56) References Cited

U.S. PATENT DOCUMENTS

| | | | | |
|---|---|---|---|---|
| 4,689,810 | A * | 8/1987 | Devine, Jr. | H01J 35/108 378/127 |
| 5,204,891 | A * | 4/1993 | Woodruff | H01J 35/108 378/125 |
| 5,943,389 | A * | 8/1999 | Lee | H01J 35/108 378/143 |
| 2010/0284520 | A1 * | 11/2010 | Reis | H01J 35/108 378/144 |

FOREIGN PATENT DOCUMENTS

| | | |
|---|---|---|
| JP | 3-34244 | 2/1991 |
| JP | 3-95840 | 4/1991 |
| JP | 5-205675 | 8/1993 |

* cited by examiner

*Primary Examiner* — Irakli Kiknadze
(74) *Attorney, Agent, or Firm* — Oblon, McClelland, Maier & Neustadt, L.L.P.

(57) ABSTRACT

According to one embodiment, an X-ray tube including an electron emission source which emits an electron, an anode target which comprises a target layer emitting an X-ray by the electron from the electron emission source, and a substrate supporting the target layer and composed from a carbide-strengthened molybdenum alloy, an evacuated outer surrounding envelope which contains the electron emission source and the anode target, a diffusion barrier layer which is integrally formed with the substrate by a powder metallurgy method on a part of a top surface of the substrate and is composed of a high-melting-point metal lacking of carbon-element content compared with carbon-element content in the substrate, and a thermal radiation film which is formed on at least a part of a top surface of the diffusion barrier layer and composed of metallic oxide.

18 Claims, 2 Drawing Sheets

X-RAY TUBE AND ANODE TARGET

CROSS-REFERENCE TO RELATED APPLICATIONS

This application is based upon and claims the benefit of priority from Japanese Patent Application No. 2013-095324, filed Apr. 30, 2013, the entire contents of which are incorporated herein by reference.

FIELD

Embodiments described herein relate generally to an X-ray tube and an anode target.

BACKGROUND

An X-ray tube, in which X-rays output, comprises an anode target. Electron beams collide with the anode target to produce X-rays.

X-ray apparatuses incorporating the X-ray tube are utilized for many purposes such as medical diagnosis and industrial nondestructive testing or materials analysis.

In a rotating anode X-ray tube, electrons emitted from a fixed cathode are accelerated and focused by a potential gradient between the cathode and a rotating anode target. The electrons colliding with the surface of the anode target typically with kinetic energy of 20 to 150 keV by the acceleration. Thus, a focal point which becomes the source of X-rays is formed on the target surface.

When such high-kinetic energy electron beams strike the anode target, they are rapidly decelerated by the target material, and thus, X-rays are emitted from the focal point. The target surface comprises a metal having a high melting point such as tungsten or a tungsten alloy. The target surface is formed on a substrate (target main body) comprising a metal having a high melting point such as molybdenum or a molybdenum alloy. Particularly, in the case of an X-ray tube for computed tomography or angiography, which requires the use of high-strengthened electron beams, etc., the temperature of or thermal stress on the substrate during use becomes high. Since, a carbide-strengthened molybdenum alloy such as titanium zirconium molybdenum (TZM) is employed for the substrate. The proportion of the kinetic energy of the electrons striking the anode target that is converted into X-rays is very small at approximately 1%. The rest of the kinetic energy is converted into heat.

In order to easily diffuse the heat produced in an anode target, a thermal radiation film is formed on a part of the top surface of the anode target. The thermal radiation film is generally formed of a metallic oxide composite such as titanium oxide and alumina using, for example, the plasma-spray technique.

However, the amount of gaseous CO and $CO_2$ produced during use is large for an anode target having the aforementioned thermal radiation film formed of metallic oxide such as titanium oxide and alumina on the top surface of a higher carbon-element content molybdenum alloy such as TZM. The gasses produced are gradually released into the vacuum within the X-ray tube and ultimately allow an electric discharge to occur in the tube. As a result, the working life of the X-ray tube is shortened.

As suggested in the Jpn. Pat. Appln. KOKAI Publication No. 05-205675, CO gas are presumed to be produced by the chemical reaction between the carbon or metallic carbide in TZM and the metallic oxide composing the thermal radiation film. As a structure to prevent this reaction, the KOKAI Publication No. 05-205675 discloses a structure of forming a reactive barrier layer that forms carbide by the reaction with carbon in the TZM substrate between the TZM substrate and the thermal radiation film by the plasma-spray technique. The KOKAI Publication No. 05-205675 also discloses a structure of forming a protective coating that is thinner than the reactive barrier layer between the reactive barrier layer and the thermal radiation film in order to further enhance the reliability.

DETAILED DESCRIPTION

In general, according to one embodiment, an X-ray tube comprising: an electron emission source which emits an electron; an anode target which comprises a target layer emitting an X-ray by the electron from the electron emission source, and a substrate supporting the target layer and composed of a carbide-strengthened molybdenum alloy; an evacuated outer surrounding envelope which contains the electron emission source and the anode target; a diffusion barrier layer which is integrally formed with the substrate by a powder metallurgy method on a part of a top surface of the substrate and is composed of a high-melting-point metal lacking of carbon-element content compared with carbon-element content in the substrate; and a thermal radiation film which is formed on at least a part of a top surface of the diffusion barrier layer and composed of metallic oxide.

Embodiments will now be described hereinafter in detail with reference to the accompanying drawings.

Figure 1:
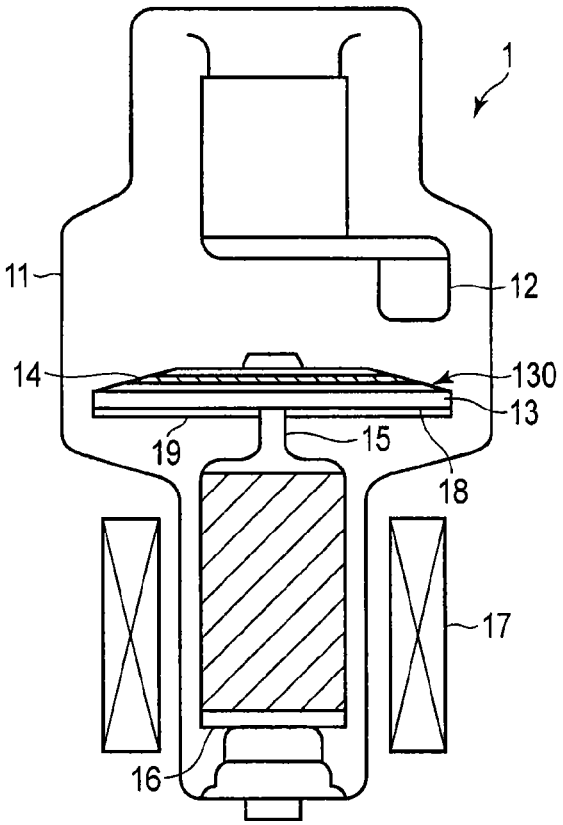
FIG. 1 is an exemplary diagram showing an example of an X-ray tube according to an embodiment.

FIG. 1 shows an example of a rotating anode X-ray tube to which an embodiment is applied.

A rotating anode X-ray tube 1 comprises an evacuated outer surrounding envelope (outer chamber) 11 which is formed of glass, and a cathode 12 which is eccentrically positioned inside the evacuated outer surrounding envelope 11. Inside the evacuated outer surrounding envelope 11, an umbrella like of discoid rotating body (anode target) 130 is provided, facing the cathode 12.

A substrate 13 of the discoid rotating body 130 is composed of a metal with a high melting point such as molybdenum, tungsten, a molybdenum alloy, a tungsten alloy or TZM (titanium zirconium molybdenum/carbide-strengthened molybdenum alloy). The discoid rotating body 130 is mounted to a rotor 16 through a shaft 15. A target layer 14 is annularly provided at a predetermined position of the discoid rotating body 130. In the target layer 14, X-rays are produced by collision of electron beams from the cathode 12.

The target layer 14 is composed of tungsten or a tungsten alloy such as a rhenium-tungsten alloy.

The rotor 16 is rotated by the influence of a stator 17 provided outside the evacuated outer surrounding envelope 11. By the rotation of the rotor 16, the discoid rotating body 130 is rotated. A fixed secure shaft (not shown in the figure) is mounted, and a bearing provided between the rotor 16 and the fixed secure shaft, inside the rotor 16.

On the bottom surface of the discoid rotating body 130; in short, on the rotor 16 side, a diffusion barrier layer 18 and a thermal radiation film 19 are positioned. The diffusion barrier layer 18 is a barrier layer which is formed of a high-melting-point metal which, compared with TZM, lacks carbon-element (or is low carbon-element), and is integrally formed with the substrate 13 of the discoid rotating body 130, or with the substrate 13 and the target layer 14, by the powder metallurgy method. The thermal radiation film 19 is formed so as to cover at least a part of the top surface of the diffusion barrier layer 18 (almost whole area on the rotor 16 side), and is composed of metallic oxide such as titanium oxide and alumina. Specifically, the diffusion barrier layer 18 is pure molybdenum whose contained mass of carbon-element is less than 0.005% by weight.

In the rotating anode X-ray tube 1 of the above structure, when the rotating anode X-ray tube 1 is operated, electron beams are released from the cathode 12 and strike the target layer 14, and the target layer 14 produces X-rays. As a result of the collision of electron beams, the temperature of the discoid rotating body (anode target) 130 is increased. At this time, the above diffusion barrier layer 18 inhibits the production of gaseous CO or $CO_2$ caused by the chemical reaction between the carbon or metallic carbide in TZM (or molybdenum, tungsten, a molybdenum alloy or a tungsten alloy) composing the substrate 13 of the discoid rotating body 130 and the metallic oxide of the thermal radiation film 19.

Figure 2:
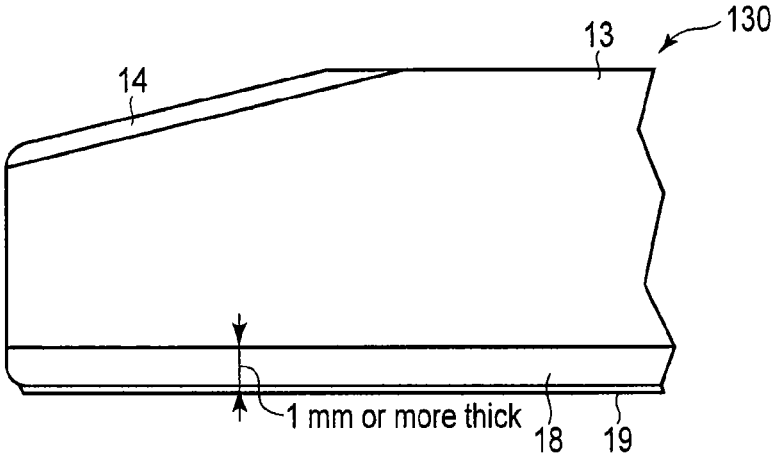
FIG. 2 is an exemplary diagram showing an example of an anode of an X-ray tube according to an embodiment.

As shown in FIG. 2, the diffusion barrier layer 18 is formed such that the shortest distance (the thickness of the diffusion barrier layer 18) from the top surface of the diffusion barrier layer 18 to the substrate 13 is greater than or equal to 1 mm. The blocking effect of the diffusion barrier layer 18 against the diffusion of the carbon-element contained in the substrate 13 to the thermal radiation film 19 is naturally increased as the thickness of the diffusion barrier layer 18 increases. However, the inventor has confirmed that a thickness greater than or equal to 1 mm can achieve a sufficient effect (an effect of reducing the amount of gaseous CO or $CO_2$ produced to 1/10 or less). Further, since the diffusion barrier layer 18 is integrally formed with the substrate 13 by the powder metallurgy method, there is no possibility of removal no matter how thick the diffusion barrier layer 18 becomes. Thus, although the layout inside the evacuated outer surrounding envelope 11 should be considered, there is no (direct) upper limit to the thickness (macroscopically, the thickness may exceed 1 cm).

Figure 3:
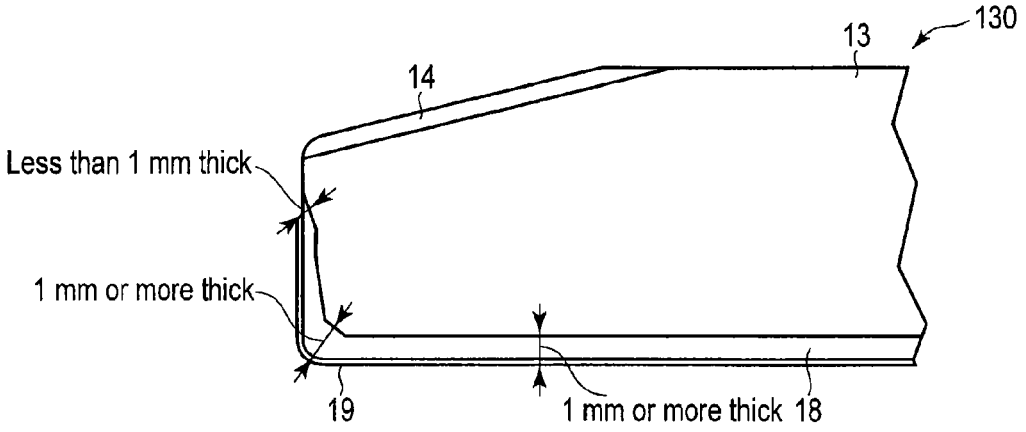
FIG. 3 is an exemplary diagram showing an example of an anode of an X-ray tube according to an embodiment.
Figure 4:
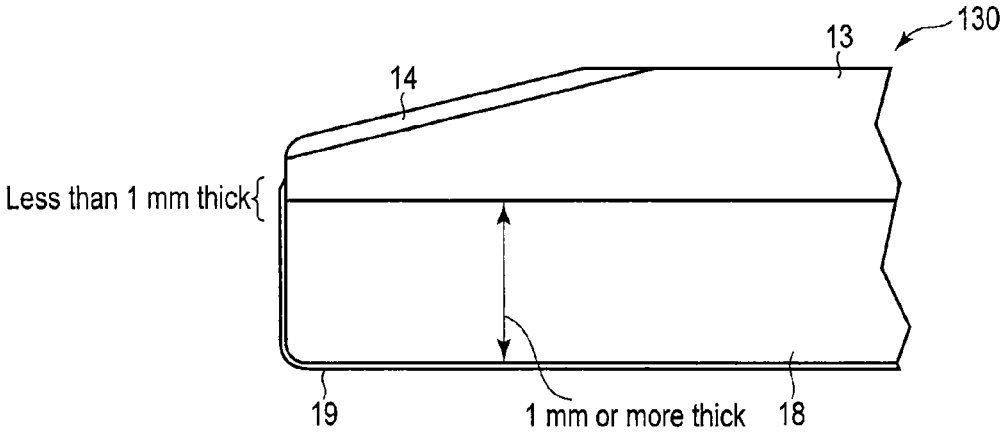
FIG. 4 is an exemplary diagram showing an example of an anode of an X-ray tube.

In a case where the diffusion barrier layer 18 extends to the outer circumferential surface of the discoid rotating body 130 (the outer circumferential rotating surface which is the concentric circle of the rotational center) as shown in FIG. 3, or in a case where the thickness of the diffusion barrier layer 18 is greater than the substrate as shown in FIG. 4, the thermal radiation film 19 can be formed on the outer circumferential surface of the discoid rotating body 130. Even if the thermal radiation film 19 is formed on the outer circumferential surface of the discoid rotating body 130 has a region where the shortest distance from the phase boundary between the diffusion barrier layer 18 and the thermal radiation film 19 to the substrate 13 is less than 1 mm, or a region where the thermal radiation film 19 protrudes from the top surface of the diffusion barrier layer 18 and is directly formed on the top surface of the substrate 13, the effect of the embodiments described herein can be obtained provided the total surface area of the above mentioned regions is less than or equal to 20% of the surface area of the whole thermal radiation film 19. In other words, it is possible to reduce the gaseous CO or $CO_2$ produced by the chemical reaction between the carbon or metallic carbide contained in the substrate 13 and the metallic oxide of the thermal radiation film 19.

Thus, in an X-ray tube using an anode target having a thermal radiation film of metallic oxide on a high carbon-element molybdenum alloy (substrate), it is possible to reduce the gaseous CO or $CO_2$ produced during use and improve the working life of the X-ray tube.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the embodiments, a rotating anode X-ray tube is explained. However, the present invention can be also applied to a fixed anode X-ray tube. Further, the inventor has not confirmed specifically which value less than 1 mm is the lower limit of the thickness of the diffusion barrier layer 18 which can bring about the effect of the embodiments. However, it is possible to obtain this lower limit if time is invested, and it goes without saying that the effect of the embodiments can be obtained by setting the thickness of the diffusion barrier layer 18 to be greater than or equal to the obtained lower limit.

What is claimed is:

1. An X-ray tube comprising:

an electron emission source which emits an electron;

an anode target which comprises a target layer emitting an X-ray by the electron from the electron emission source, and a substrate supporting the target layer and composed of a carbide-strengthened molybdenum alloy;

an evacuated outer surrounding envelope which contains the electron emission source and the anode target;

a diffusion barrier layer which is integrally formed with the substrate by a powder metallurgy method on a part of a top surface of the substrate and is composed of a high-melting-point metal lacking of carbon-element content compared with carbon-element content in the substrate; and a thermal radiation film which is formed on at least a part of a top surface of the diffusion barrier layer and composed of metallic oxide.

2. The X-ray tube of claim 1, wherein the diffusion barrier layer prevents a carbon-element component contained in the substrate from reaching the thermal radiation film.

3. The X-ray tube of claim 2, wherein the diffusion barrier layer is integrally formed with the substrate and the target layer by the powder metallurgy method.

4. The X-ray tube of claim 2, wherein a shortest distance from the top surface of the diffusion barrier layer to the substrate is greater than or equal to 1 mm.

5. The X-ray tube of claim 2, wherein the diffusion barrier layer is pure molybdenum whose contained mass of carbon-element is less than 0.005% by weight.

6. The X-ray tube of claim 1, wherein the diffusion barrier layer is integrally formed with the substrate and the target layer by the powder metallurgy method.

7. The X-ray tube of claim 6, wherein a shortest distance from the top surface of the diffusion barrier layer to the substrate is greater than or equal to 1 mm.

8. The X-ray tube of claim 6, wherein the diffusion barrier layer is pure molybdenum whose contained mass of carbon-element is less than 0.005% by weight.

9. The X-ray tube of claim 1, wherein a shortest distance from the top surface of the diffusion barrier layer to the substrate is greater than or equal to 1 mm.

10. The X-ray tube of claim 9, wherein the diffusion barrier layer is pure molybdenum whose contained mass of carbon-element is less than 0.005% by weight.

11. The X-ray tube of claim 1, wherein the diffusion barrier layer is pure molybdenum whose contained mass of carbon-element is less than 0.005% by weight.

12. An anode target comprising a target layer which emits an X-ray by an electron from an electron emission source, and a substrate which supports the target layer and is composed from a carbide-strengthened molybdenum alloy, the anode target comprising:

a diffusion barrier layer which is integrally formed with the substrate by a powder metallurgy method on a part of a top surface of the substrate and is composed of a high-melting-point metal lacking of carbon-element content compared with carbon-element content in the substrate; and a thermal radiation film which is formed of metallic oxide and is formed on at least a part of a top surface of the diffusion barrier layer.

13. The anode target of claim 12, wherein the diffusion barrier layer is integrally formed with the substrate and the target layer by the powder metallurgy method.

14. The anode target of claim 13, wherein a shortest distance from the top surface of the diffusion barrier layer to the substrate is greater than or equal to 1 mm.

15. The anode target of claim 13, wherein the diffusion barrier layer is pure molybdenum whose contained mass of carbon-element is less than 0.005% by weight.

16. The anode target of claim 12, wherein a shortest distance from the top surface of the diffusion barrier layer to the substrate is greater than or equal to 1 mm.

17. The anode target of claim 16, wherein the diffusion barrier layer is pure molybdenum whose contained mass of carbon-element is less than 0.005% by weight.

18. The anode target of claim 12, wherein the diffusion barrier layer is pure molybdenum whose contained mass of carbon-element is less than 0.005% by weight.

* * * * *